US008816947B2

(12) United States Patent
Hwang et al.

(10) Patent No.: US 8,816,947 B2
(45) Date of Patent: Aug. 26, 2014

(54) LIQUID CRYSTAL DISPLAY DEVICE AND DRIVING METHOD THEREOF

(75) Inventors: Han Wook Hwang, Gumi-si (KR); Sang Ho Kim, Chungcheongnam-do (KR)

(73) Assignee: LG Display Co., Ltd., Seoul (KR)

( * ) Notice: Subject to any disclaimer, the term of this patent is extended or adjusted under 35 U.S.C. 154(b) by 729 days.

(21) Appl. No.: 11/242,856

(22) Filed: Oct. 5, 2005

(65) Prior Publication Data

US 2006/0145985 A1 Jul. 6, 2006

(30) Foreign Application Priority Data

Dec. 31, 2004 (KR) ..... 10-2004-118604

(51) Int. Cl.
*G09G 3/36* (2006.01)

(52) U.S. Cl.
CPC ..... *G09G 3/3655* (2013.01); *G09G 2300/0426* (2013.01); *G09G 2300/0434* (2013.01); *G09G 2300/0465* (2013.01); *G09G 2330/021* (2013.01)
USPC ..... 345/87; 349/39; 349/43

(58) Field of Classification Search
USPC ..... 345/90, 92, 97, 214
See application file for complete search history.

(56) References Cited

U.S. PATENT DOCUMENTS 5,182,661 A * 1/1993 Ikeda et al. ..... 349/38
5,686,932 A * 11/1997 Tomita ..... 345/94
6,064,459 A * 5/2000 Lee ..... 349/139
6,403,409 B1 * 6/2002 You ..... 438/164
6,827,622 B2 * 12/2004 Yamada et al. ..... 445/24
6,839,043 B2 * 1/2005 Nakajima ..... 345/87
6,897,909 B2 * 5/2005 Ochiai et al. ..... 349/43
2002/0126081 A1 * 9/2002 Adachi et al. ..... 345/92
2003/0053321 A1 * 3/2003 Ishiyama ..... 363/59
2003/0227429 A1 * 12/2003 Shimoshikiryo ..... 345/90
2005/0094042 A1 * 5/2005 Kim et al. ..... 349/28
2005/0094078 A1 * 5/2005 Kang ..... 349/141
2006/0044485 A1 * 3/2006 Park et al. ..... 349/42
2006/0262263 A1 * 11/2006 Yang et al. ..... 349/141

FOREIGN PATENT DOCUMENTS

JP 7-230075 A 8/1995
JP 2003-323160 A 11/2003

* cited by examiner

*Primary Examiner* — Seokyun Moon
(74) *Attorney, Agent, or Firm* — McKenna Long & Aldridge, LLP

(57) ABSTRACT

A liquid crystal display device includes a liquid crystal display panel having a thin film transistor connected to a gate line and a data line on a substrate, a pixel electrode connected to the thin film transistor, a common electrode for forming a horizontal electric field with the pixel electrode, a common line connected to the common electrode and parallel to the gate line, and a storage line parallel to the gate line and having a portion overlapping the pixel electrode with at least one insulating film therebetween to form a storage capacitor, a gate driver for supplying a scan pulse to the gate line, a data driver for supplying a pixel voltage signal to the data line, a common driver for supplying a common voltage signal to the common line, and a storage driver for supplying a storage voltage signal to a storage line.

17 Claims, 6 Drawing Sheets

LIQUID CRYSTAL DISPLAY DEVICE AND DRIVING METHOD THEREOF

The present invention claims the benefit of Korean Patent Application No. P2004-118604 filed in Korea on Dec. 31, 2004, which is hereby incorporated by reference.

BACKGROUND OF THE INVENTION

1. Field of the Invention

The present invention relates to a liquid crystal display device, and more particularly to a horizontal electric field type liquid crystal display device and a driving method thereof that improve a picture quality and reduce power consumption.

2. Discussion of the Related Art

A liquid crystal display (LCD) device controls light transmissivity of liquid crystal molecules using an electric field to display images. A liquid crystal display device is generally divided into a vertical electric field type and a horizontal electric field type in accordance with the direction of the electric field that controls the liquid crystal molecules.

A vertical electric field type liquid crystal display device has a common electrode formed on an upper substrate and a pixel electrode formed on a lower substrate arranged opposite to each other to generate a vertical electric field therebetween and to drive liquid crystal molecules of a twisted nematic TN mode using the vertical electric field. The vertical electric field type liquid crystal display device has an advantage of a high aperture ratio, but a disadvantage of a narrow viewing angle of about 90°.

In contrast, a horizontal electric field type liquid crystal display device has a common electrode and a pixel electrode arranged in parallel on a lower substrate to generate a horizontal vertical electric field therebetween and to drive liquid crystal molecules of an in-plane switch mode using the horizontal electric field. The horizontal electric field type liquid crystal display device has an advantage of a wide viewing angle of about 160°.

FIG. 1 is a schematic block diagram illustrating a horizontal electric field type liquid crystal display device according to the related art. In FIG. 1, a horizontal electric field type liquid crystal display device includes a liquid crystal display panel 10, a data driver 2 for driving data lines DL1 . . . DLm of the liquid crystal display panel 10, a gate driver 4 for driving gate lines GL1 . . . GLn of the liquid crystal display panel 10, a timing controller 6 for controlling the gate driver 4 and the data driver 2, and a common voltage generator 8 for supplying a reference voltage signal to a common line CL of the liquid crystal display panel 10.

The timing controller 6 supplies pixel data signals R, G, B Data inputted from an external source (not shown) to the data driver 2. Further, the timing controller 6 generates a gate control signal GDC and a data control signal DDC for respectively controlling the gate driver 4 and the data driver 2 in response to control signals inputted from the external source (not shown). The gate control signal GDC includes a gate start pulse, a gate shift clock signal and a gate output enable signal. The data control signal DDC includes a source start pulse, a source shift clock signal, a source output enable signal and a polarity control signal.

In addition, the gate driver 4 sequentially supplies a scan pulse to the gate lines GL1 . . . GLn in response to the gate control signal GDC from the timing controller 6. Accordingly, the gate driver 4 drives a thin film transistor TFT, which is connected to one of the gate lines GL1 . . . GLn. Further, the data driver 2 supplies pixel voltage signals of one horizontal line to the data lines DL1 . . . DLm for each horizontal period in response to the data control signal DDC. Particularly, the data driver 2 converts the digital pixel signal data R, G, B Data into analog pixel voltage signals using a gamma voltage from a gamma voltage generator (not shown) and supplies the converted analog pixel voltage signals. Moreover, the common voltage generator 8 generates a common voltage and supplies the generated common voltage to a common electrode, which forms a horizontal electric field with a pixel electrode, through the common line CL.

The liquid crystal display panel 10 includes a thin film transistor TFT formed at each of intersections of the gate lines GL1 . . . GLn and the data lines DL1 . . . DLm, and a liquid crystal cell connected to each thin film transistor TFT. The thin film transistors TFTs and the liquid crystal cells are arranged in a matrix shape. The thin film transistors TFT supply the data from the data lines DL1 . . . DLm to the liquid crystal cells in response to the gate signal from the gate line GL1 . . . GLn. The liquid crystal cell is made of the pixel electrode which is connected to the thin film transistor TFT, and a common electrode which forms a horizontal electric field with and in parallel to the pixel electrode and is connected to the common line CL, thus it can be equivalently indicated as a liquid crystal capacitor Clc. The liquid crystal cell Clc includes a storage capacitor Cst formed of the common line CL and the pixel electrode which overlap each other with an insulating film of at least one layer therebetween in order to maintain the pixel voltage signal charged in the liquid crystal capacitor Clc until the next pixel voltage signal is charged therein.

Accordingly, the horizontal electric field type liquid crystal display device can improve the picture quality when it is driven using a dot inversion method. However, there is a problem in that its power consumption is high.

SUMMARY OF THE INVENTION

Accordingly, the present invention is directed to a liquid crystal display and a driving method thereof that substantially obviate one or more of the problems due to limitations and disadvantages of the related art.

An object of the present invention is to provide a liquid crystal display device that is adaptive for improving a picture quality as well as reducing power consumption, and a driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a liquid crystal display panel having a thin film transistor connected to a gate line and a data line on a substrate, a pixel electrode connected to the thin film transistor, a common electrode for forming a horizontal electric field with the pixel electrode, a common line connected to the common electrode and parallel to the gate line, and a storage line parallel to the gate line and having a portion overlapping the pixel electrode with at least one insulating film therebetween to form a storage capacitor, a gate driver for supplying a scan pulse to the gate line, a data driver for supplying a pixel voltage signal to the data line, a common driver for supplying a common voltage signal to the common line, and a storage driver for supplying a storage voltage signal to a storage line.

In another aspect, a driving method for a liquid crystal display device includes supplying a scan pulse to a gate line for driving a thin film transistor connected to the gate line, supplying a pixel voltage signal to a pixel electrode through a data line and the thin film transistor, supplying a common voltage signal to a common line, the common line connected to a common electrode and parallel to the gate line and the common electrode forming a horizontal electric field with the pixel electrode, and supplying a storage voltage signal to a storage line, the storage line parallel to the gate line and having a portion overlapping a pixel electrode with at least one insulating film therebetween to form a storage capacitor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
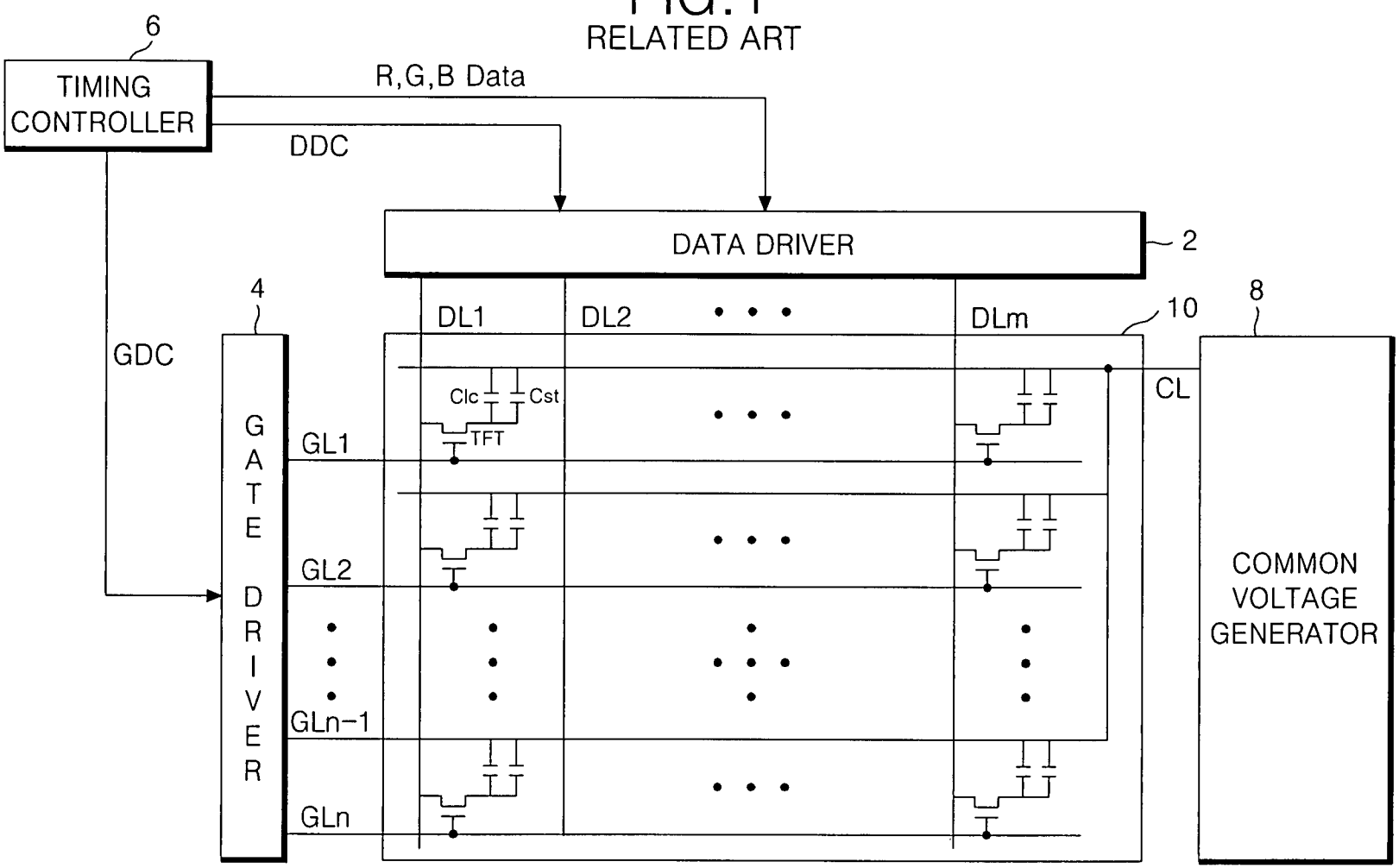
FIG. 1 RELATED ART
FIG. 1 is a schematic block diagram illustrating a horizontal electric field type liquid crystal display device according to the related art.
Figure 2:
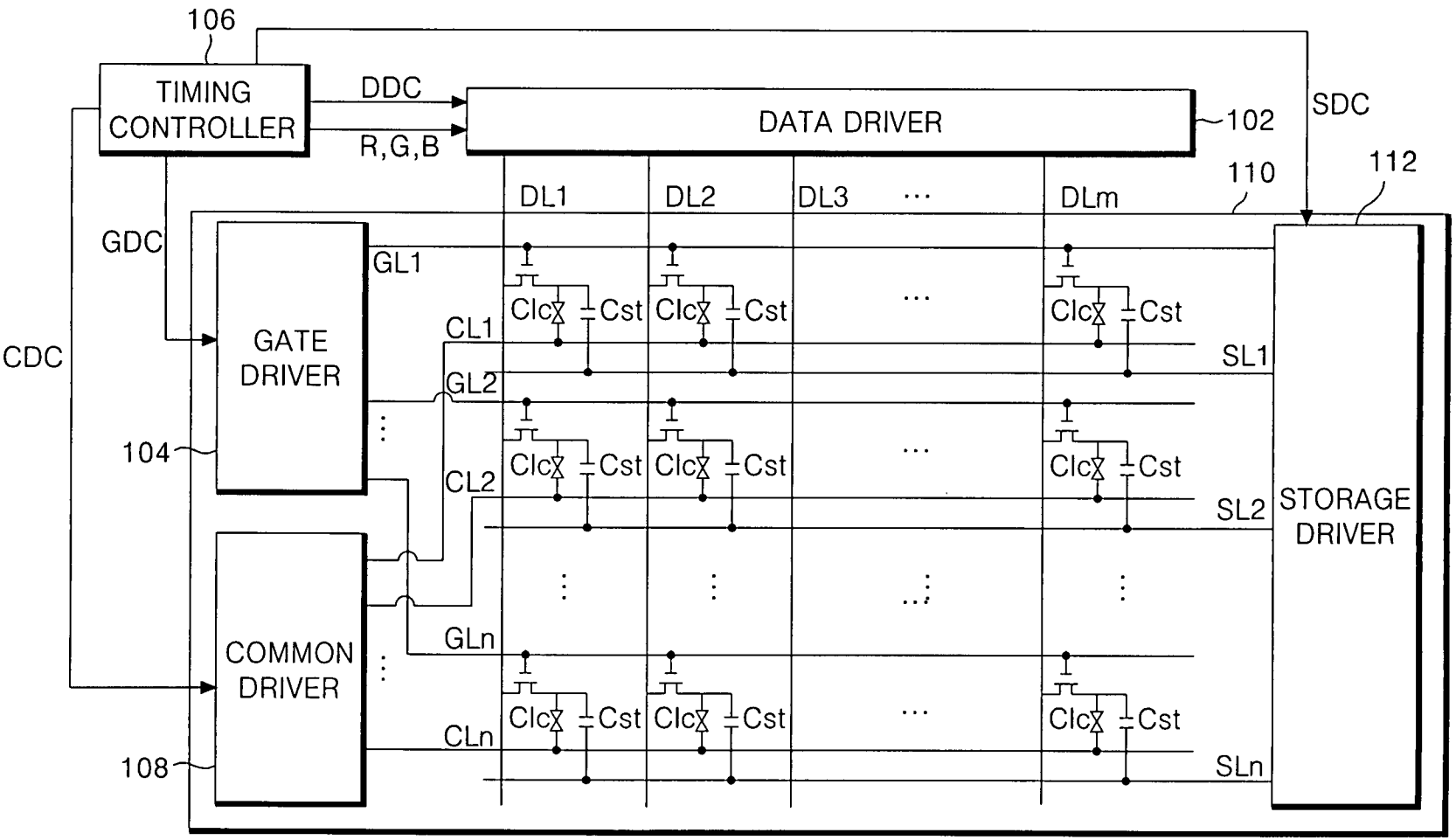
FIG. 2 is a schematic block diagram illustrating a liquid crystal display device according to an embodiment of the present invention.

FIG. 2 is a schematic block diagram illustrating a liquid crystal display device according to an embodiment of the present invention. In FIG. 2, a horizontal electric field type liquid crystal display device includes a liquid crystal display panel 110, a data driver 102, a gate driver 104, a common driver 108, a storage driver 112, and a timing controller 106 for controlling the gate driver 104, the data driver 102, the common driver 108 and the storage driver 112.

The liquid crystal display panel 110 includes a plurality of data lines DL1 . . . DLm along a first direction, and a plurality of gate lines GL1 . . . GLn, common lines CL1 . . . CLn, and storage lines SL1 . . . SLn along a second direction. The gate lines GL1 . . . GLn, the common lines CL1 . . . CLn, and the storage lines SL1 . . . SLn are arranged parallel to each other and intersect the data lines DL1 . . . DLm. A liquid crystal cell is formed at each of the regions defined by intersections of the gate lines GL1 . . . GLn and the data lines DL1 . . . DLm. Each of the liquid crystal cells includes a thin film transistor, a storage capacitor Cst and a liquid crystal capacitor Clc.

In addition, the gate driver 104, the common driver 108, the storage driver 112 includes thin film transistors formed on and integrated with a substrate of the liquid crystal display panel 110. For example, the gate driver 104, the common driver 108, the storage driver 112 may be formed in the same fabrication process as the thin film transistor being formed in a display area of the liquid crystal display panel 110. The thin film transistors in the gate driver 104, the common driver 108 and the storage driver 112 may be amorphous silicon type thin film transistors or poly silicon type thin film transistors with high charge mobility. In particular, the poly silicon type thin film transistors may be integrated with the substrate by use of a CMOS process. In addition, the common driver 108 may be formed on the same side of the substrate as the gate driver 104, and the storage driver 112 may be formed on a side of the substrate opposite from the gate driver 104 and the common driver 108.

The timing controller 106 supplies a pixel data signal R, G, B inputted from an external source (not shown) to the data driver 102. Further, the timing controller 106 generates a data control signal DDC, a gate control signal GDC, a storage control signal SDC and a common control signal CDC for controlling the data driver 102, the gate driver 104, the storage driver 112 and the common driver 108 in response to control signals, such as horizontal synchronization signals, vertical synchronization signals, data enable signals and clock signals, inputted from the external source (not shown). In particular, the gate control signal GDC may include a gate start pulse, a gate shift clock signal and a gate output enable signal. The data control signal DDC may include a source start pulse, a source shift clock signal, a source output enable signal and a polarity control signal.

The data driver 102 supplies pixel signals of one horizontal line to the data lines DL1 . . . DLm for each horizontal period in response to the data control signal DDC from the timing controller 106. Particularly, the pixel data signal R, G, B may be a digital signal, and the data driver 102 converts the digital pixel data R, G, B from the timing controller 106 into an analog pixel voltage signal using a gamma voltage from a gamma voltage generator (not shown) and supplies the converted analog pixel signal. The data driver 102 may supply the pixel voltage signal having a different polarity for each horizontal line period using a line inversion method.

In addition, the gate driver 104 sequentially supplies a scan pulse to the gate lines GL1 . . . GLn in response to the gate control signal GDC from the timing controller 106. Accordingly, the gate driver 104 drives the thin film transistor TFT, which is connected to one of the gate lines GL1 . . . GLn. Further, the common driver 108 supplies a common voltage signal to the common lines CL1 . . . GLn, which is sequentially inverted, in response to the common control signal CDC from the timing controller 106. The common voltage signal may be an AC voltage having a polarity inverted for each horizontal period and opposite to a polarity of the pixel voltage signal.

The storage driver 112 supplies a storage voltage signal, which is subsequently inverted, to the storage lines SL1 . . . SLn in response to the storage control signal SDC from the timing controller 106. The storage voltage signal may be an AC voltage having a polarity inverted at about the beginning of each horizontal period and having the same amplitude as the common voltage signal.

In particular, the output voltage level of the storage driver 112 may be in accordance with the presence or absence of ions injected into an active layer of an area which overlaps the storage lines SL1 . . . SLn. For example, when the storage ions are doped in the active layer, the storage driver 112 may generate a storage voltage signal having the same voltage level and amplitude as the common voltage signal. When the storage ions are not doped in the active layer, the storage driver 112 may generate a storage voltage that swings at a positive voltage level or at a negative voltage level in accordance with the ions injected into the source area and the drain area of the active layer.

Figure 3:
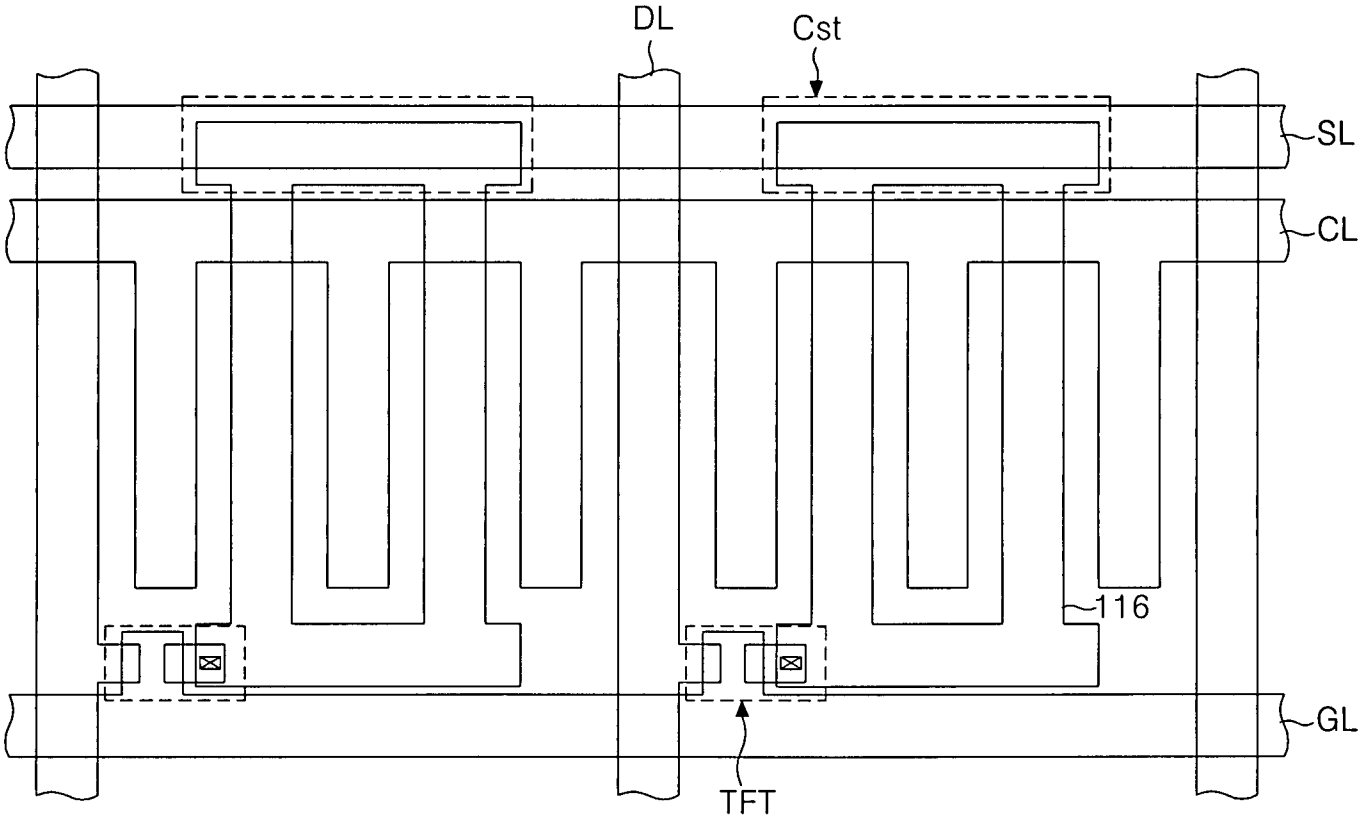
FIG. 3 is a plane view illustrating a pixel region of the liquid crystal display panel shown in FIG. 2.

FIG. 3 is a plane view illustrating a pixel region of the liquid crystal display panel shown in FIG. 2. As shown in FIG. 3, each of the liquid crystal cell includes a liquid crystal capacitor Clc which has a thin film transistor TFT connected to a respective gate line GL and a respective data line DL, a pixel electrode 116 connected to the thin film transistor TFT, and a common electrode 114 connected to a respective common line CL and parallel to the pixel electrode 116 to form a horizontal electric field. In particular, the liquid crystal capacitor Clc may be formed of the pixel electrode 116 and the common electrode 114.

In addition, each of the liquid crystal cells further includes a storage capacitor Cst where the pixel electrode 116 overlaps a respective storage line SL with at least one insulating film therebetween. The storage capacitor includes a poly silicon type active layer having storage ions injected therein or a poly silicon type active layer without storage ions injected therein. Thus, the storage capacitor Cst maintains the data voltage charged in the liquid crystal capacitor Clc until the next data voltage is charged. Also, each of the common line CL and the storage line SL is independently formed on a substrate when the gate line GL is formed on the substrate. Accordingly, the gate line GL, the common line CL and the storage line SL are formed on the surface of the substrate.

Figure 4:
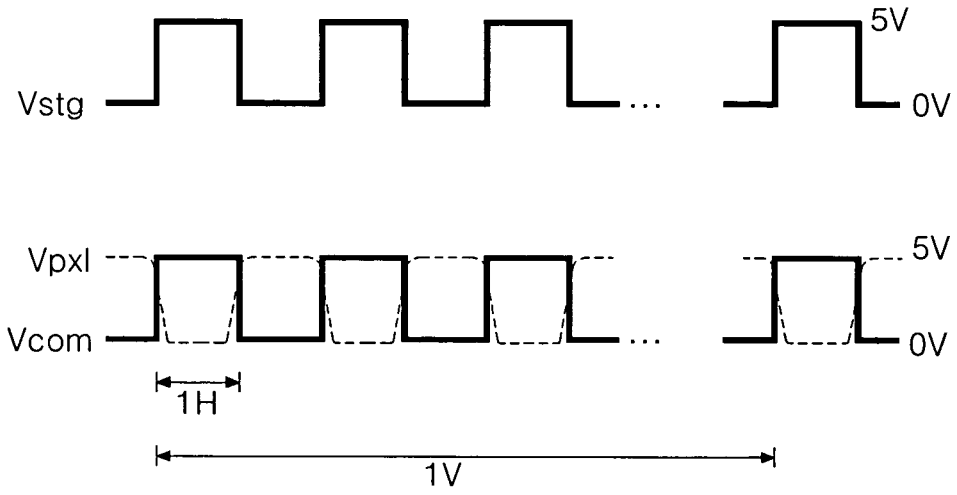
FIGS. 4 and 5 are waveform diagrams illustrating a common voltage signal and a storage voltage signal applied to the liquid crystal display panel shown in FIG. 2 according to an embodiment of the present invention.
Figure 5:
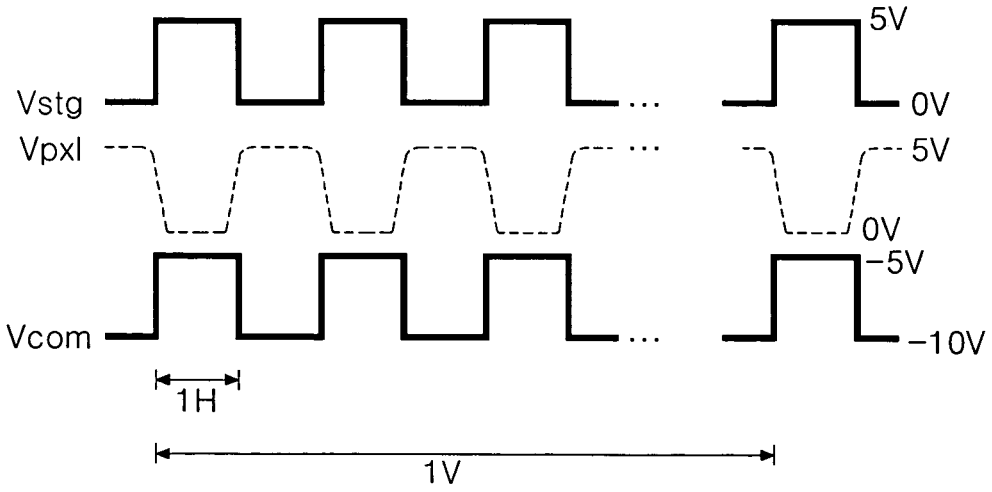

FIGS. 4 and 5 are waveform diagrams illustrating a common voltage signal and a storage voltage signal applied to the liquid crystal display panel shown in FIG. 2 according to an embodiment of the present invention. As shown in FIG. 4, when the storage ions are doped in the active layer, the storage voltage signal Vstg to be applied to the storage line SL (shown in FIG. 3) may have the same waveform as the common voltage signal Vcom to be applied to the common line CL (shown in FIG. 3). In particular, during a first horizontal period 1H, a negative (−) pixel voltage signal Vpxl, a positive (+) common voltage signal Vcom and a positive (+) storage voltage signal Vstb are supplied to the liquid crystal cells, which are connected to an $i^{th}$ horizontal line. During a subsequent horizontal period, a positive (+) pixel voltage signal Vpxl, a negative (−) common voltage signal Vcom and a negative (−) storage voltage signal Vstb are supplied to the liquid crystal cells, which are connected to an $(i+1)^{th}$ horizontal line.

When the storage ions are not doped in the active layer, the storage voltage Vstg, which swings at a positive voltage level or at a negative voltage level in accordance with the ions injected into the source area and the drain area of the active layer, is supplied to the storage line SL (shown in FIG. 3). In particular, when p+ions are injected into the source area and the drain area of the active layer, the common voltage Vcom may swing at the positive (+) voltage level and may be supplied to the common line CL (shown in FIG. 3). Meanwhile, the storage voltage Vstg may swing at the negative (−) voltage level and may be supplied to the storage line SL (shown in FIG. 3). For example, the common voltage may swing between about 0V~5V, and the storage voltage Vstg may swing between about −10V~−5V or between bout −5V~−3V. Then, the storage line SL (shown in FIG. 3) of the poly silicon membrane form is changed in the sequence of accumulation →depletion→inversion, thus the positive storage voltage Vstg, of which the level is the same as the positive voltage level supplied to the common line substantially, is applied to the storage line SL (shown in FIG. 3).

As shown in FIG. 5, when n+ions are injected into the source area and the drain area of the active layer, the common voltage Vcom, which swings at the negative (−) voltage level, is supplied to the common line CL (shown in FIG. 3), and the storage voltage Vstg, which swings at the positive (+) voltage level, is supplied to the storage line SL (shown in FIG. 3). For example, the common voltage, which swings between 5V~10V, is supplied to the common line CL (shown in FIG. 3), and the storage voltage Vstg, which swings between 0V~5V, is supplied to the storage line SL (shown in FIG. 3). Then, the storage line SL (shown in FIG. 3) of the poly silicon membrane form is changed in the sequence of accumulation →depletion→inversion, thus the negative storage voltage, of which the level is the same as the negative voltage level supplied to the common line substantially, is applied to the storage line SL (shown in FIG. 3).

Accordingly, during one horizontal period 1H, the negative (−) pixel voltage signal Vpxl is supplied to the pixel electrode of the liquid crystal cell connected to the ith horizontal line, a positive (+) common voltage signal Vcom is supplied to the common line, and a positive (+) storage voltage signal Vstg is supplied to the storage line SL (shown in FIG. 3) by the inversion of the poly silicon membrane (storage line) even though a negative (−) storage voltage Vstg is supplied to the storage line SL (shown in FIG. 3). During a subsequent horizontal period, the positive (+) pixel voltage signal Vpxl is supplied to the pixel electrode of the liquid crystal cell connected to the $(i+1)^{th}$ horizontal line, a negative (−) common voltage signal Vcom is supplied to the common line, and a negative (−) storage voltage signal Vstg is supplied to the storage line SL (shown in FIG. 3) by the inversion of the poly silicon membrane (storage line) even though a positive (+) storage voltage Vstg is supplied to the storage line SL (shown in FIG. 3).

Accordingly, the liquid crystal display device according to an embodiment of the present invention can reduce the pixel voltage signal by a common voltage signal, which is inverted for one horizontal period, to be relatively lower than in a dot inversion method. Accordingly, the power consumption of the data driver can be reduced. Further, the liquid crystal display device according to an embodiment of the present invention supplies the storage voltage, which swings at the negative voltage level, to the storage line if the thin film transistor driving the liquid crystal cell is a PMOS type. Moreover, the liquid crystal display device according to an embodiment of the present invention supplies the storage voltage, which swings at the positive voltage level, to the storage line if the thin film transistor driving the liquid crystal cell is an NMOS type. In this case, the process of injecting impurities ions to the storage area of the active layer can be omitted.

Further, in the horizontal field effect type liquid crystal display device according to an embodiment of the present invention, the line resistance is reduced more than the related art because the common line and the storage line are driven by their own driver. In other words, the line resistance is reduced in the common line of an embodiment of the present invention in comparison with the common line commonly connected to a separate reference line of the related art. The common voltage signal can be easily transmitted to the common line by the reduced line resistance.

In addition, the horizontal electric field type liquid crystal display device according to an embodiment of the present invention provides a separate storage line of the storage capacitor, thereby improving the aperture ratio in comparison with the related art. In other words, a separate contact hole is required for connecting the storage line and the common line which are commonly driven through one driver in the related art, but in an embodiment of the present invention, the storage line and the common line are separately driven, thus the aperture ratio is improved because the separate contact hole is not necessary.

Figure 6:
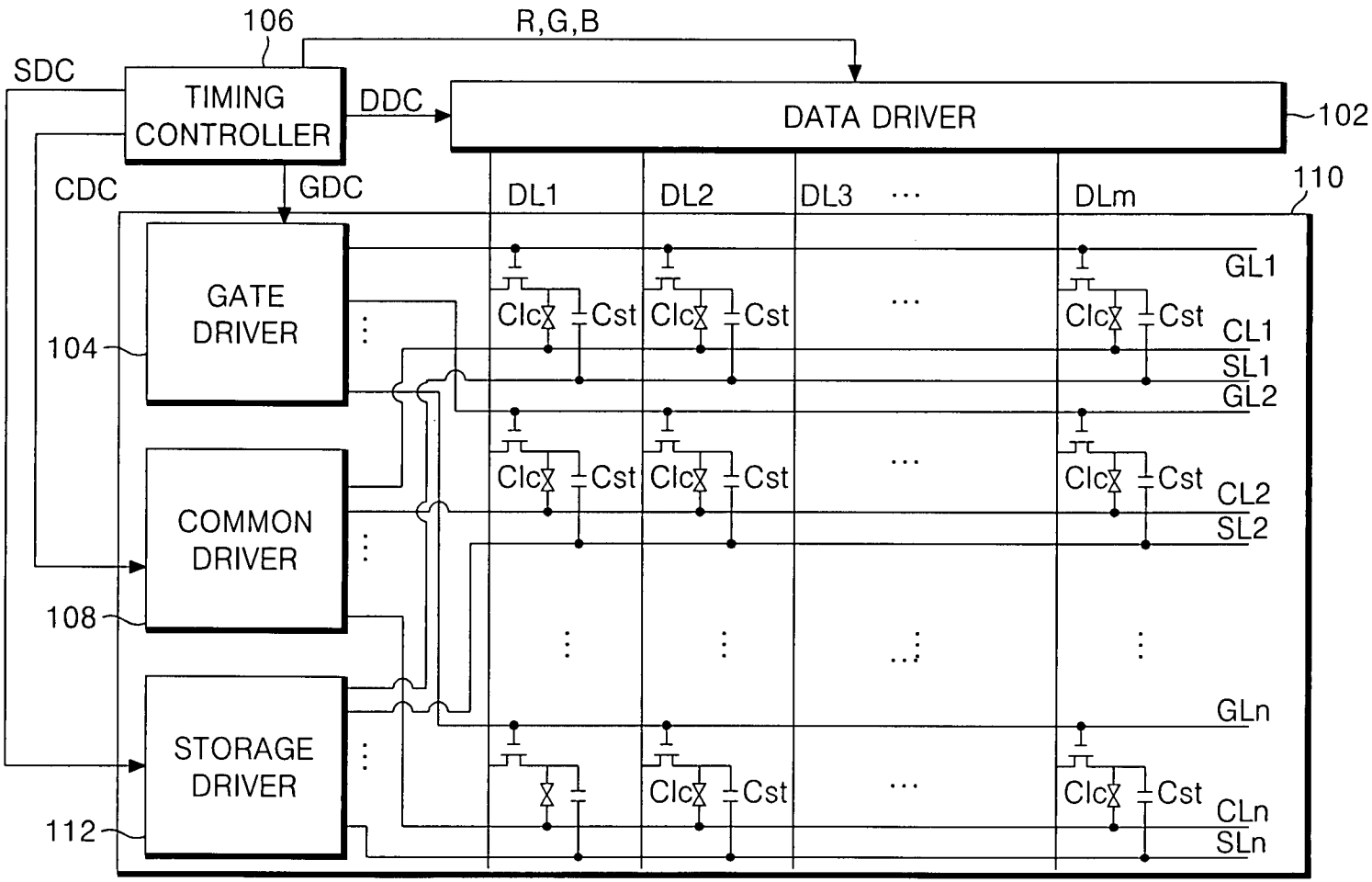
FIG. 6 is a schematic block diagram illustrating a liquid crystal display device according to another embodiment of the present invention.

FIG. 6 is a schematic block diagram illustrating a liquid crystal display device according to another embodiment of the present invention. In FIG. 6, a horizontal electric field type liquid crystal display device includes a liquid crystal display panel 110, a data driver 102, a gate driver 104, a common driver 108, a storage driver 112, and a timing controller 106 for controlling the gate driver 104, the data driver 102, the common driver 108 and the storage driver 112.

The liquid crystal display panel 110 includes a plurality of data lines DL1 . . . DLm along a first direction, and a plurality of gate lines GL1 . . . GLn, common lines CL1 . . . CLn, and storage lines SL1 . . . SLn along a second direction. The gate lines GL1 . . . GLn, the common lines CL1 . . . CLn, and the storage lines SL1 . . . SLn are arranged parallel to each other and intersect the data lines DL1 . . . DLm. A liquid crystal cell is formed at each of the regions defined by intersections of the gate lines GL1 . . . GLn and the data lines DL1 . . . DLm. Each of the liquid crystal cells includes a thin film transistor, a storage capacitor Cst and a liquid crystal capacitor Clc.

In addition, the gate driver 104, the common driver 108 and the storage driver 112 may be formed on the same side of a substrate of the liquid crystal display panel 110. In particular, the gate driver 104, the common driver 108, the storage driver 112 may include thin film transistors formed on and integrated with the substrate of the liquid crystal display panel 110. For example, the gate driver 104, the common driver 108, the storage driver 112 may be formed in the same fabrication process as the thin film transistor being formed in a display area of the liquid crystal display panel 110. The thin film transistors in the gate driver 104, the common driver 108 and the storage driver 112 may be amorphous silicon type thin film transistors or poly silicon type thin film transistors with high charge mobility. In particular, the poly silicon type thin film transistors may be integrated with the substrate by use of a CMOS process.

The common driver 108 supplies a common voltage signal to the common lines CL1 . . . GLn, which is sequentially inverted, in response to a common control signal CDC from the timing controller 106. The common voltage signal may be an AC voltage having a polarity inverted for each horizontal period and opposite to a polarity of the pixel voltage signal.

The storage driver 112 supplies a storage voltage signal, which is subsequently inverted for each horizontal line, to the storage lines SL1 . . . SLn in response to a storage control signal SDC from the timing controller 106. The storage voltage signal may be an AC voltage having a polarity inverted for each horizontal period and having the same amplitude as the common voltage signal. For example, when the storage ions are doped in the storage line SL, the storage voltage signal, which has the same voltage level and amplitude as the common voltage signal supplied to the common line, may be supplied to the storage line.

When the storage ions are not doped in the storage line SL, the storage voltage, which swings at a positive voltage level or at a negative voltage level in accordance with the ions injected into the source area and the drain area of the active layer, may be supplied to the storage line SL. For example, if p+ions are injected into the source area and the drain area of the active layer, and the common voltage Vcom which swings at the positive (+) voltage level is supplied to the common line CL, then the storage voltage which swings at the negative (-) voltage level is supplied to the storage line SL.

Accordingly, in the horizontal electric field liquid crystal display device according to an embodiment of the present invention, the common line and the storage line are respectively driven by a common driver and a storage driver. As a result, a line resistance of the common line is reduced in comparison with the related art. Further, the horizontal electric field type liquid crystal display device according to an embodiment of the present invention provides the storage line of the storage capacitor separately, thereby improving the aperture ratio in comparison with the related art.

Figure 7:
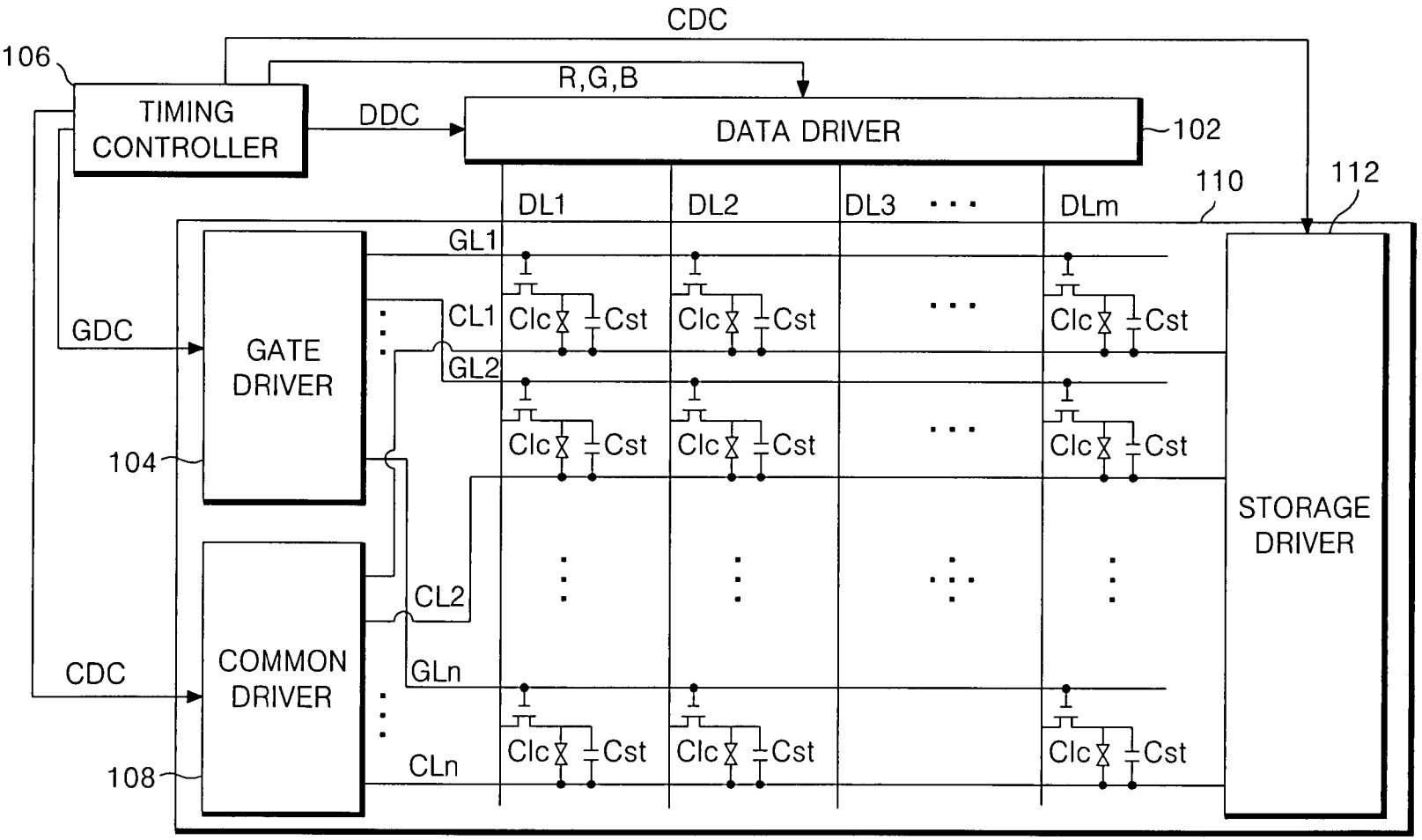
FIG. 7 is a schematic block diagram illustrating a liquid crystal display device according to yet another embodiment of the present invention.

FIG. 7 is a schematic block diagram illustrating a liquid crystal display device according to yet another embodiment of the present invention. In FIG. 7, a horizontal electric field type liquid crystal display device includes a liquid crystal display panel 110, a data driver 102, a gate driver 104, a common driver 108, a storage driver 112, and a timing controller 106 for controlling the gate driver 104, the data driver 102, the common driver 108 and the storage driver 112.

The liquid crystal display panel 110 includes a plurality of data lines DL1 . . . DLm along a first direction, and a plurality of gate lines GL1 . . . GLn and common lines CL1 . . . CLn along a second direction. The gate lines GL1 . . . GLn and the common lines CL1 . . . CLn are arranged parallel to each other and intersect the data lines DL1 . . . DLm. In addition, one end of each of the common lines CL1 . . . CLn is connected to the common driver 108, and another end of each of the common lines CL1 . . . CLn is connected to the storage driver 112. The common driver 108 may be formed on the same side of the substrate as the gate driver 104, and the storage driver 112 may be formed on a side of the substrate opposite from the gate driver 104 and the common driver 108.

In particular, the common driver 108 and the storage driver 112 supplies a common voltage signal to the common lines CL1 . . . GLn, which is sequentially inverted, in response to a common control signal CDC from the timing controller 106. The common voltage signal may be an AC voltage having a polarity inverted for each horizontal period and opposite to a polarity of the pixel voltage signal. Accordingly, when the storage driver 112 malfunctions, the connection of the storage driver 112 and the common line CL may be severed and the common line CL may still be driven by the common driver 108. Similarly, when the common driver 108 malfunctions, the connection of the common driver 108 and the common line CL may be severed and the common line CL may still be driven by the storage driver 112.

Accordingly, the liquid crystal display device according to an embodiment of the present invention has the common line and the storage line respectively driven by a common driver and a storage driver, thereby reducing a line resistance in the common line as compared to the related art. Further, the liquid crystal display device according to an embodiment of the present invention provides the storage line to form a storage capacitor, thereby improving the aperture ratio in comparison with the related art.

In addition, the liquid crystal display device according to an embodiment of the present invention supplies the storage voltage, which swings at the negative voltage level, to the storage line if the thin film transistor driving the liquid crystal cell is a PMOS type. Further, the liquid crystal display device according to another embodiment of the present invention supplies the storage voltage, which swings at the positive voltage level, to the storage line if the thin film transistor driving the liquid crystal cell is an NMOS type. As a result, a process of injecting ions to the storage area of the active layer can be omitted.

It will be apparent to those skilled in the art that various modifications and variations can be made in the liquid crystal display device and the driving method thereof of the present invention without departing from the spirit or scope of the invention. Thus, it is intended that the present invention covers the modifications and variations of this invention provided they come within the scope of the appended claims and their equivalents.

What is claimed is:

1. A liquid crystal display device, comprising:

a liquid crystal display panel having a thin film transistor connected to a gate line and a data line on a substrate, a pixel electrode connected to the thin film transistor, a common electrode for forming a horizontal electric field with the pixel electrode, a common line connected to the common electrode and parallel to the gate line, and a storage line parallel to the gate line, wherein a portion of the storage line and the pixel electrode overlap with at least one insulating film therebetween to form a storage capacitor, and wherein a portion of the pixel electrode crosses the common line to form the storage capacitor with the storage line;

a gate driver for supplying a scan pulse to the gate line;

a data driver for supplying a pixel voltage signal to the data line;

a common driver for supplying a common voltage signal to the common line; and a storage driver for supplying a storage voltage signal to a storage line, wherein the storage capacitor includes a poly silicon type active layer, wherein the storage line is a separate line which is different from the gate line, and wherein the gate line and the common line face each other across a pixel area where the pixel electrode and the common electrode are disposed, wherein the storage line is formed adjacent to the common line, wherein an end portion of the pixel electrode is parallel with the storage line and overlapped with the portion of the storage line, and wherein only the pixel electrode is disposed in a region bounded by the storage line, the common line, and two adjacent data lines.

2. The liquid crystal display device according to claim 1, wherein the data driver, the common driver and the storage driver respectively invert a polarity of the pixel voltage signal, a polarity of the common voltage signal and a polarity of the storage voltage signal at about a beginning of each horizontal period.

3. The liquid crystal display device according to claim 2, wherein the polarity of the common voltage signal is opposite from the polarity of the pixel voltage signal.

4. The liquid crystal display device according to claim 2, wherein a voltage level and an amplitude of the storage voltage signal are the same as the common voltage signal.

5. The liquid crystal display device according to claim 4, wherein the storage capacitor includes a poly silicon type active layer having storage ions injected therein.

6. The liquid crystal display device according to claim 2, wherein an amplitude of the storage voltage signal is the same as the common voltage signal, and the polarity of the storage voltage is opposite from the polarity of the common voltage signal.

7. The liquid crystal display device according to claim 6, wherein the storage capacitor includes a poly silicon type active layer formed without injecting storage ions therein.

8. The liquid crystal display device according to claim 1, wherein the gate driver, the common driver and the storage driver are integrated into the substrate.

9. The liquid crystal display device according to claim 1, wherein the gate driver and at least one of the common driver and the storage driver are formed on a first side of the substrate.

10. The liquid crystal display device according to claim 1, wherein the storage line and the common lines are separate lines arrange parallel to each other.

11. A driving method for a liquid crystal display device, comprising:

supplying a scan pulse to a gate line for driving a thin film transistor connected to the gate line;

supplying a pixel voltage signal to a pixel electrode through a data line and the thin film transistor;

supplying a common voltage signal to a common line, the common line connected to a common electrode and parallel to the gate line and the common electrode forming a horizontal electric field with the pixel electrode; and supplying a storage voltage signal to a storage line, the storage line parallel to the gate line, wherein a portion of the storage line and the pixel electrode overlap with at least one insulating film therebetween to form a storage capacitor, wherein a portion of the pixel electrode crosses the common line to form the storage capacitor with the storage line, wherein the storage capacitor includes a poly silicon type active layer, wherein the storage line is a separate line which is different from the gate line, and wherein the gate line and the common line face each other across a pixel area where the pixel electrode and the common electrode are disposed, wherein the storage line is formed adjacent to the common line, wherein an end portion of the pixel electrode is parallel with the storage line and overlapped with the portion of the storage line, and wherein only the pixel electrode is disposed in a region bounded by the storage line, the common line, and two adjacent data lines.

12. The driving method according to claim 11, further comprising:

inverting a polarity of the pixel voltage signal, a polarity of the common voltage signal and a polarity of the storage voltage signal at about a beginning of each horizontal period.

13. The driving method according to claim 12, further comprising:

setting the polarity of the common voltage signal to be opposite from the polarity of the pixel voltage signal.

14. The driving method according to claim 13, further comprising:

setting a voltage level and an amplitude of the storage voltage signal to be the same as the common voltage signal.

15. The driving method according to claim 13, further comprising:

setting an amplitude of the storage voltage signal to be the same as the common voltage signal; and setting the polarity of the storage voltage to be opposite from the polarity of the common voltage signal.

16. The liquid crystal display device according to claim 1, wherein the pixel electrode includes first and second pixel electrode sections that are parallel to adjacent sections of the common electrode to form the horizontal electric field, and wherein at least one of the first and second pixel electrode sections extends across the common line to form the storage capacitor with the storage line.

17. The driving method according to claim 11, wherein the pixel electrode includes first and second pixel electrode sections that are parallel to adjacent sections of the common electrode to form the horizontal electric field, and wherein at least one of the first and second pixel electrode sections extends across the common line to form the storage capacitor with the storage line.

* * * * *